United States Patent [19]

Müller

[11] Patent Number: 4,510,736

[45] Date of Patent: Apr. 16, 1985

[54] MACHINE FOR FILLING AND CLOSING BAGS OF SYNTHETIC PLASTIC MATERIAL

[75] Inventor: Mathias Müller, Viersen, Fed. Rep. of Germany

[73] Assignee: Haver & Becker, Oelde, Fed. Rep. of Germany

[21] Appl. No.: 376,844

[22] Filed: May 10, 1982

[30] Foreign Application Priority Data

May 13, 1981 [DE] Fed. Rep. of Germany ..... 3118866

[51] Int. Cl.[3] ..... B65B 9/10

[52] U.S. Cl. ..... 53/567; 53/266 R; 53/373; 53/386; 53/570

[58] Field of Search ..... 53/567, 570, 386, 373, 53/266 R, 568, 563, 384

[56] References Cited

U.S. PATENT DOCUMENTS

| | | | |
|---|---|---|---|
| 3,750,721 | 8/1973 | Hudson | 53/570 X |
| 3,903,677 | 9/1975 | Bowman et al. | 53/384 |
| 3,948,019 | 4/1976 | Döring | 53/567 X |
| 4,108,300 | 8/1978 | Hayase et al. | 53/570 X |
| 4,172,349 | 10/1979 | Lipes | 53/572 X |
| 4,174,599 | 11/1979 | Callet et al. | 53/386 X |

FOREIGN PATENT DOCUMENTS

| | | | |
|---|---|---|---|
| 1948228 | 4/1971 | Fed. Rep. of Germany | 53/373 |
| 2519253 | 11/1976 | Fed. Rep. of Germany | 53/567 |

*Primary Examiner*—John Sipos
*Assistant Examiner*—Donald R. Studebaker
*Attorney, Agent, or Firm*—Michael J. Striker

[57] ABSTRACT

A machine for filling and closing bags of a synthetic plastic material has a lowerable filling device, a transporting band spaced from the filling device and intermittently moveable in a longitudinal direction, opening, filling and welding stations, two carriages arranged in a space between the transporting band and the filling device at a distance corresponding to a band width and moveable synchronously with the transporting band parallel to the longitudinal direction, a feeding means on the carriages and having two feeding arms which are provided with gripping plates and move in the opening station from an upper position to a medium expanding position to be inserted into a bag mouth, and after expanding the bag the filling arms with the gripping plates move further in a direction transverse to the longitudinal direction to a lower transporting position, and two pairs of grippers arranged on the carriages at both sides of the feeding device to grip bags below their mouth edges, wherein one of the pairs of grippers is a front pair and arranged to bring an empty bag to the opening station, whereas the other of the pairs of grippers is a rear pair and arranged for bring a filled bag from the filling station to the welding station.

30 Claims, 11 Drawing Figures

MACHINE FOR FILLING AND CLOSING BAGS OF SYNTHETIC PLASTIC MATERIAL

BACKGROUND OF THE INVENTION

The present invention relates to a machine for filling and closing bags of a synthetic plastic material, preferably lateral fold bags or flat bags.

Machines of the above-mentioned general type are known in the art. A known machine has lowerable filling pipes and an intermittently moveable transport band for the filled bags, wherein two carriages are arranged in the space between the filling pipes and the transporting band at a distance corresponding to the bag width and moveable synchronously with the transporting band parallel to its longitudinal direction. Such a machine is disclosed, for example, in a German patent application No. P 30 06 129.1-27. The carriage pair is provided with several gripper pairs and performs, in addition to a horizontal movement, a pivoting movement about a horizontal axis so as to separate the bag mouth edge by the gripper pair from the filling pipes and move in the region of the welding station into the space between the welding members. The known machines possess some disadvantages in the sense of their efficiency and space they occupy.

SUMMARY OF THE INVENTION

Accordingly, it is an object of the present invention to provide a machine for filling and closing bags of a synthetic plastic material, preferrably lateral fold bags or flat bags, which avoids the disadvantages of the prior art.

More particularly, it is an object of the present invention to provide a machine of this type which has a higher efficiency and occupies a smaller space, as compared with the known machines.

In keeping with these objects and with others which will become apparent hereinafter, one features of the present invention resides, briefly states, in a machine in which a carriage pair is provided with a feeding device having two feeding arms which move with their gripping plates in an opening station from an upper position into a bag mouth to a medium expanding position and after expanding of the bag moves transverse to the movement direction of the carriage pair to a lower transporting position, and the carriages have gripper pairs at both sides of the feeding device, of which a front gripper pair brings an empty bag to the opening station and a rear gripper pair brings the filled bag from the filling station to a welding station with holding the bags under the bag mouth edges.

When the machine is designed in accordance with the present invention, an empty bag in one working step is transported to the opening station, a bag transported in the preceding working step from the feeding device to the opening station is brought in fed condition to the filling station, and a filled bag is brought in closed condition to the closing station, so that in the further working process simultaneously a bag is opened, a bag is filled, and a filled bag is closed by a weld seam. At the smae time, the gripper pair opens the bags located alterally at a distance from the working place, the gripping plates of the feeding arms pivot inwardly and upwardly, and the carriage pair moves back prior to ending of the working cycle to conduct a next one.

The machine can be combined with an aggregate for producing bags from a hose foil. For obtaining sufficient cooling for the bottom weld seam of the finished bags, a gripper chain pair can be provided between the bag manufacturing aggregate and the carriage pair, whereby the empty bags are supplied to the front grippers of the carriage pair. During this transport path, the bottom weld seams are cooled so that they can be fully loaded.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
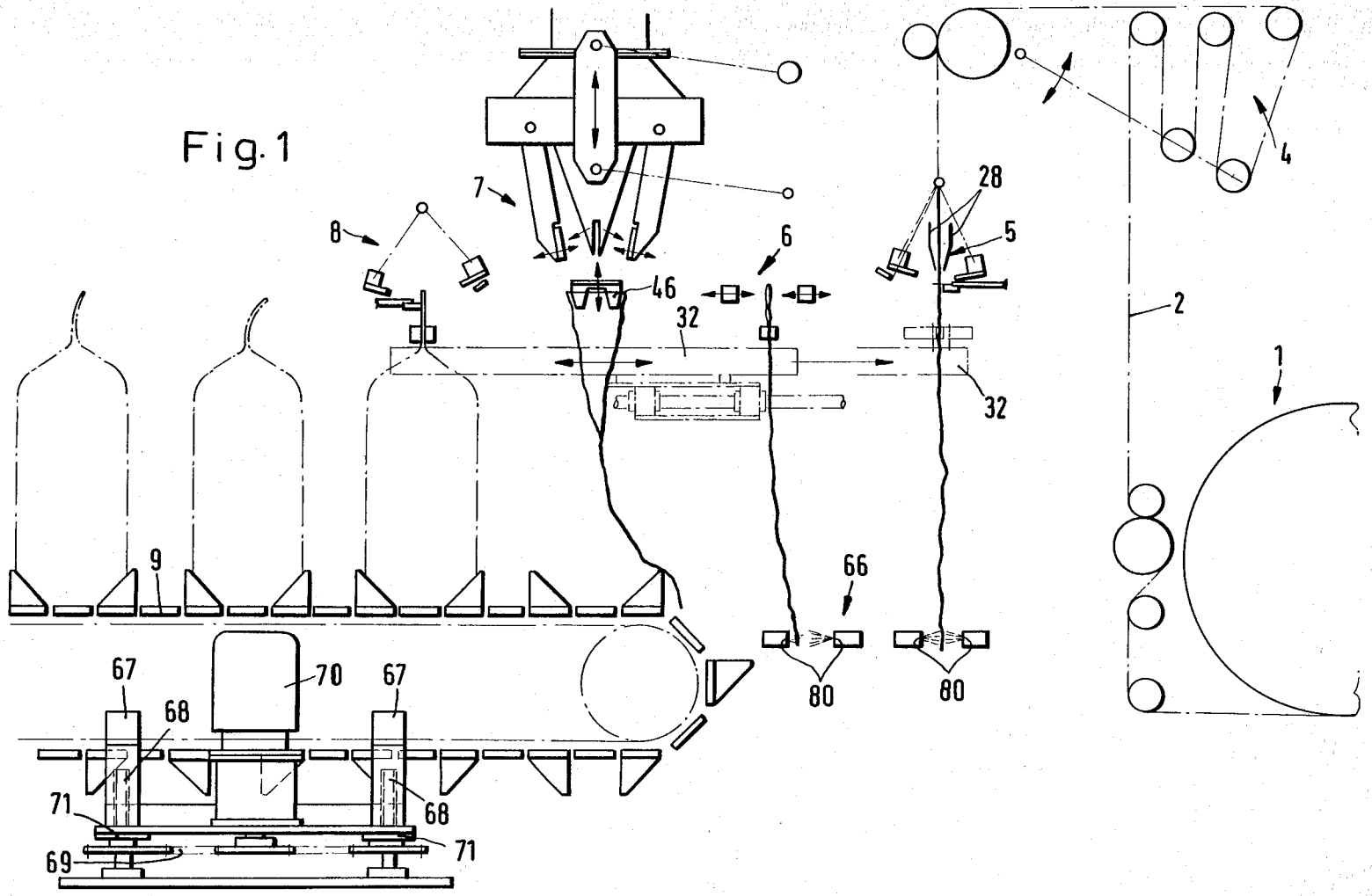
FIG. 1 is a schematic lateral view of the machine in accordance with a first embodiment of the present invention.

A machine for filling and closing bags of a synthetic plastic material shown in FIG. 1 has a roll off station 1 for a hose foil web 2, a pair of pulling rollers 3 driven intermittently in accordance with a cycle of the machine, and an accumulating device 4 for the hose foil web 2 incoming during stoppage of the roller pairs 3 from the roll-off station 1, a welding device 5 for producing a bottom weld seam, an opening station 6, and a filling station 7, a welding device 8 for closing the filled bags, and a conveyor transporting band 9 for transporting of the filled bags.

Figure 2:
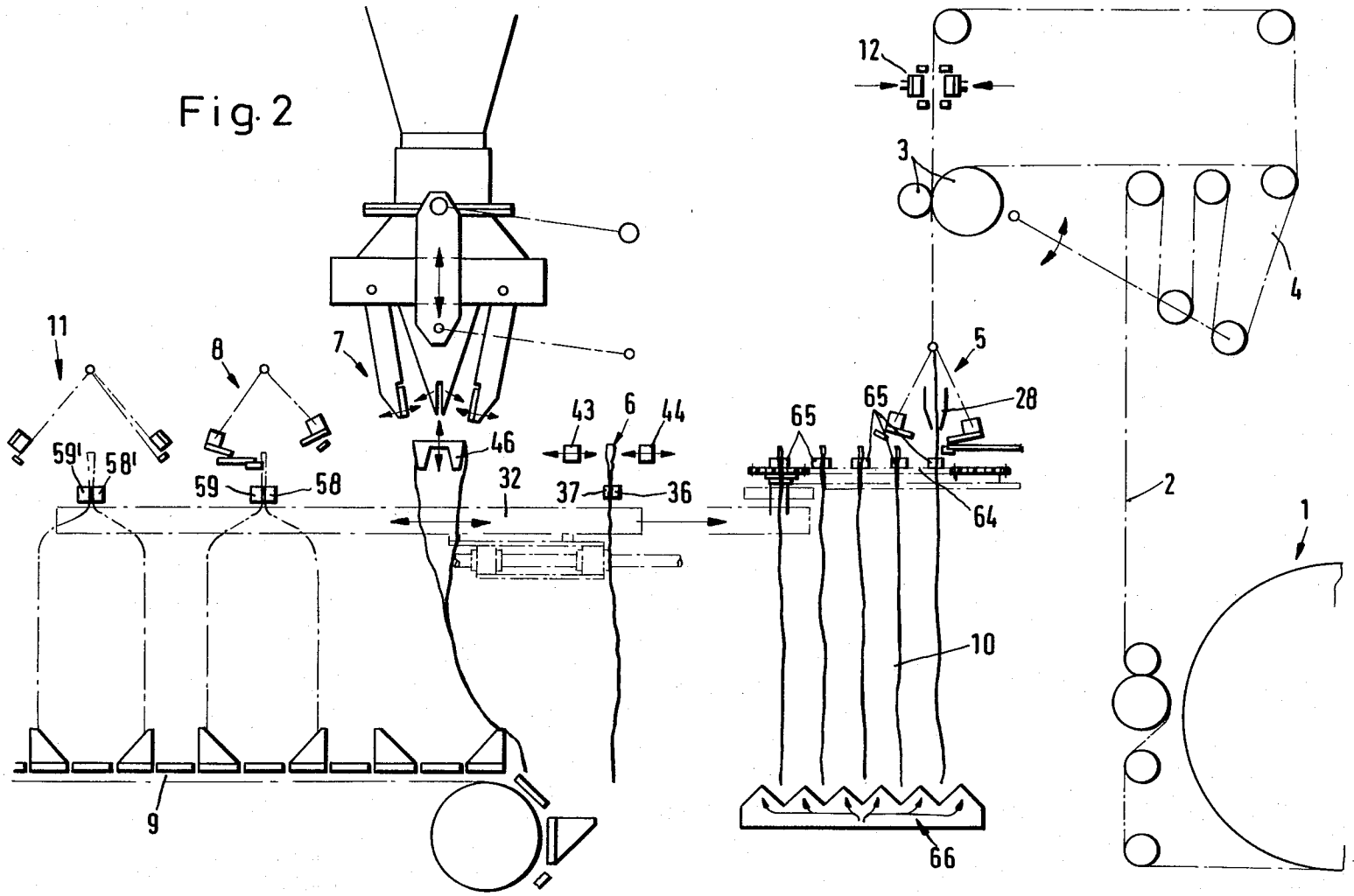
FIG. 2. is a schematic lateral view of the machine in accordance with a second embodiment of the invention.

In the embodiment shown in FIG. 2 a cooling station is additionally arranged between the welding device 5 and the opening station 6, and an additional welding device 11 is arranged after the welding device 8. Moreover, prior to the roller pair 3, as considered in running direction of the foil web 2, an additional welding device 12 is arranged for pre-welding and corner welding.

Figure 4:
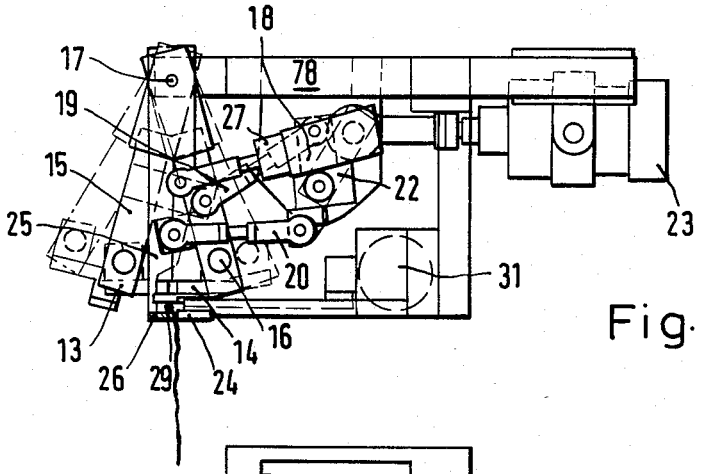
FIG. 4 is a lateral view of a welding device in according with FIGS. 1 and 2.
Figure 5:
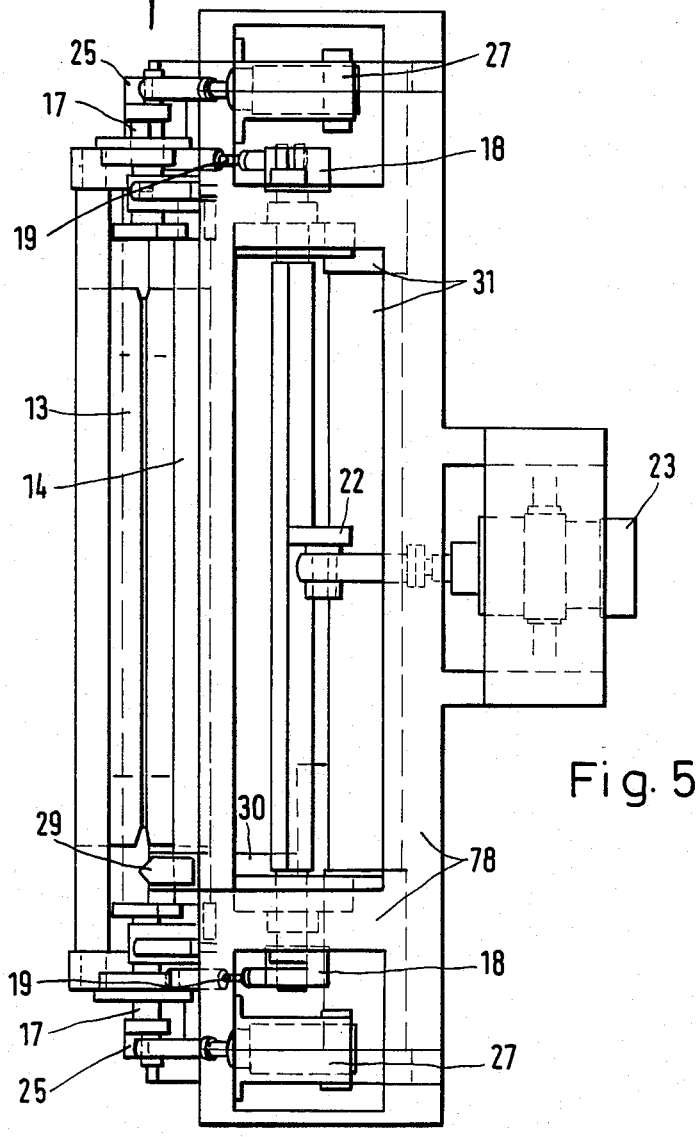
FIG. 5 is a plan view of the welding device of FIG. 4.

The welding device 5 is shown in FIGS. 4 and 5. Welding members or dies 13 and 14 are mounted on levers 15 and 16. The levers 15 and 16 are floatingly supported on axles 17 at both sides. At both sides of the welding members 13 link rods 19 acting upon double levers 18 are articulately connected. Link rods 20 are similarly articulately connected with the welding member 14 at both sides and act upon the double lever 18.

The double lever 18 is connected with the pins of a throughgoing pivot axle 21 for joint rotation therewith.

A cylinder-and-piston unit 23 acts upon the pivot axle 21 via a lever 22. As seen in the running direction of the foil web 2, a stationary clamping member 24 is arranged below the welding member 14. A clamping member 26 is mounted on a lever 25 and is pivotable about the horizontal axles 17. Cylinder-and-piston units 27 are connected with the levers 25 at both sides. As can be particularly seen from FIG. 4, the axles 17 are located in the running plane of the foil web 2. Thereby, good adjustability of both the welding members 13 and 14, and also of the moveable clamping member 26 is provided. The levers 15, 16 and 25 which carry the welding members 13 and 14 and the clamping member 26 require only low structural expenditures. As seen in the running direction of the foil web 2, a funnel-shaped guiding plate 28 is mounted prior to the welding members 13 and 14.

A displaceable separating cutter 29 is arranged between the welding member 14 and the stationary clamping member 24 transverse to the foil web. The separating cutter 29 is mounted in a cutter holder 30 which is fixedly connected with the piston of a cylinder-and-piston unit 31.

Figure 6:
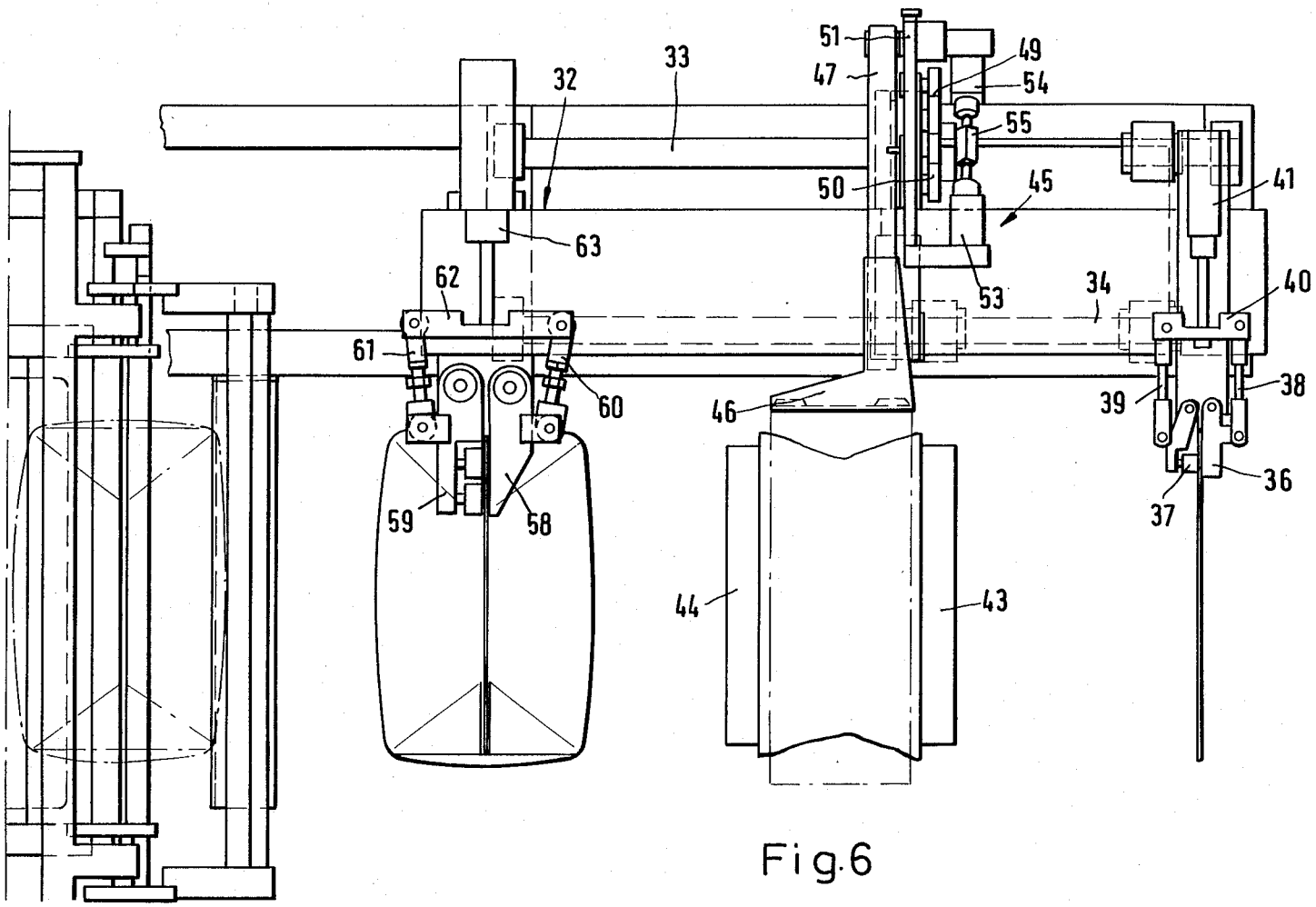
FIG. 6 is a plan view of a carriage pair in which only one carriage is shown.

FIG. 6 shows a pair of carriages 32 which are moveable from guide rods 33 and 34 at both sides in horizontal planes. Grippers 36 and 37 are pivotably supported on the carriage pair 32. Link rods 38 and 39 are articulately connected with the grippers 36 and 37 and are coupled at the opposite end by a shackle 40. A cylinder-and-piston unit 41 which is also arranged on the carriage pair 32 and centrally on the shackle 40.

The opening station 60 includes links 85 and 86 forming a parallel guide, and suction pipes 42 and 43 mounted thereon and actuated by a cylinder-and-piston unit 44. For adjusting the distance of the suction pipe 42 and 43 to the bag opening resulting from the bag shape and bag dimensions, an adjustable abutment 87 for the suction pipe 43 is arranged. Displacing of the abutment 87 provides for central displacement of both suction pipes 42 and 43 as can be seen from FIG. 3.

Figure 7:
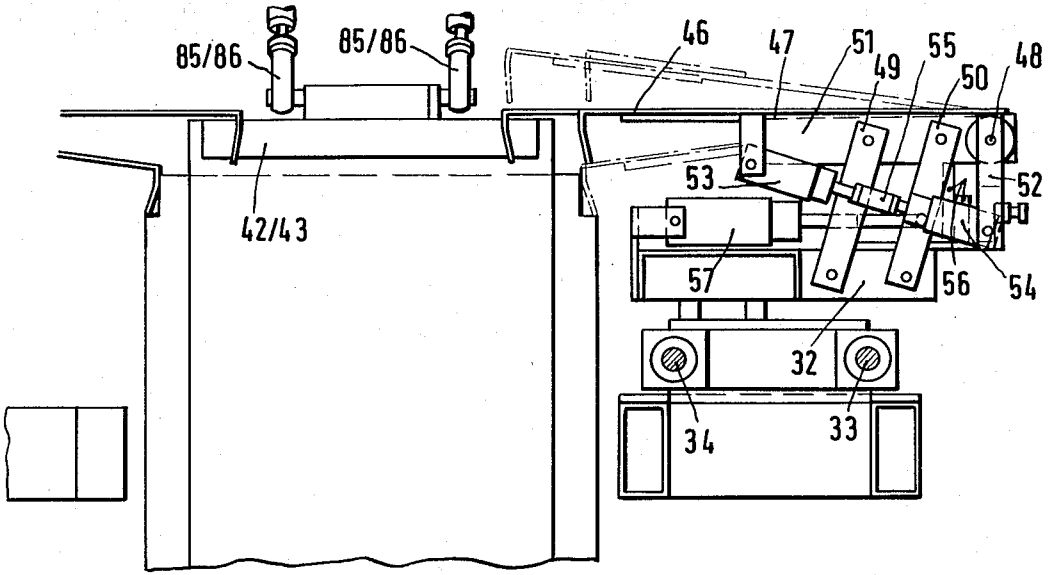
FIG. 7 is a front view of a feeding device.
Figure 8:
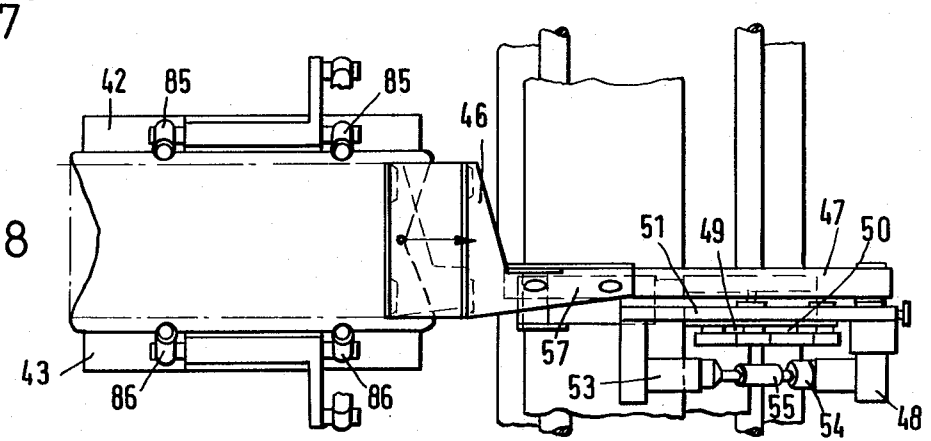
FIG. 8 is a plan view of the feeding device of FIG. 7.
Figure 9:
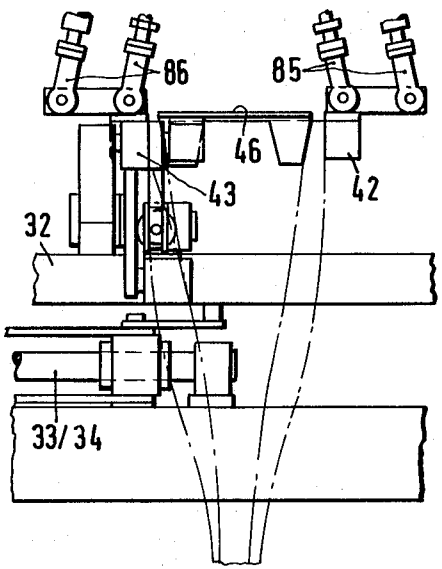
FIG. 9 is a lateral view of the feeding device of FIG. 7.

A bag feeding device 45 is arranged on the carriage pair 32 shown in FIGS. 7–9 for a machine side. A gripping plate 46 is bent at its end facing toward the machine center and screwed on a feeding arm 47. The feeding arm 47 is fixedly clamped on a horizontal axle 48 which is pivotally supported in a plate 51 connected via links 49 and 50 with the carriage pair 32. A lever 52 is fixedly clamped on the horizontal axle 48.

A cylinder-and-piston unit 53 is articulately connected with the plate 51, and an additional cylinder-and-piston unit is articulately connected with the lever 52. The cylinder-and-piston unit 53 is coupled with the cylinder-and-piston unit 54 via a connecting piece 55. Further, a cylinder-and-piston unit 57 is pivotally connected with the carriage 32 and acts transverse to the carriages 32 onto the link 50 for displacement of the feeding arm 47. The displacement is limited by an abutment 56.

Further grippers 58 and 59 are pivotally supported on the carriage pair 32. Link rods 60 and 61 are articulately connected with the grippers 58 and 59 and coupled with one another via a shackle 62. A cylinder-and-piston unit 63 mounted on the carriage pair 32 is articulately connected with the shackle 62.

In the embodiment shown in FIG. 2, further grippers 58' and 59' which are identical to the grippers 58 and 59 are provided. These grippers 58' and 59' with the actuating elements are fixedly connected with the carriage pair 32. As can also be seen from FIG. 2, a cooling station 10 is arranged between the welding device 5 and the opening station 6. Several gripper pairs 65 are mounted on an endless gripper chain 64. A cooling device 66 is located under the endless gripper chain 64.

As can be seen from FIG. 1, the conveyor transporting band 9 is adjustable with respect to its height. On a not-shown frame, spindles 58 are arranged and driven via a chain drive 69 from a drive motor 70. The spindles 68 are supported by abutments 71 arranged in pipes 67.

Figure 10:
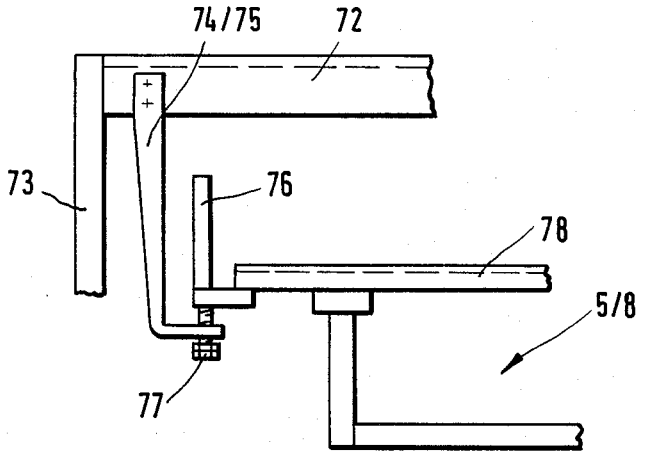
FIG. 10 is a view of a suspension for the welding device.
Figure 11:
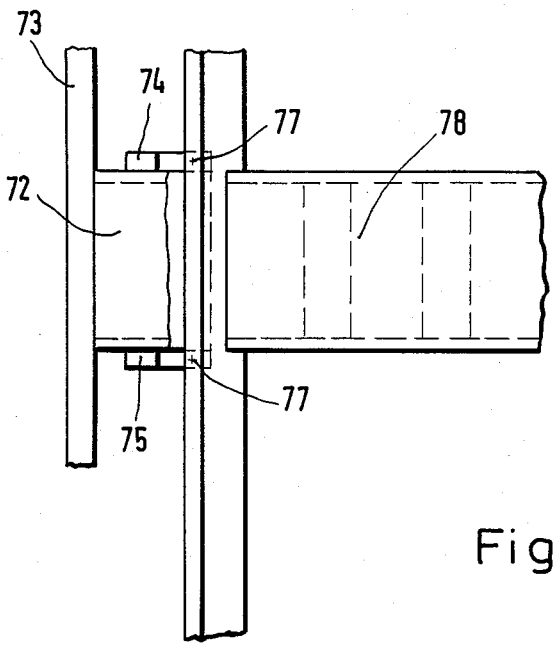
FIG. 11 is a plan view of the suspension of FIG. 10.

FIGS. 10 and 11 show a suspension of the welding devices 5 and 8. Frames 62 and 63 which support parts of the machine are provided with holders 74 and 75 bent at one end. The holders 74 and 75 carry an angle-shaped rail 76 which rests on screws 77 which are screwed in bent ends of the holders 74 and 75. Individual parts which belong to the welding devices 5 and 8 are carried by a frame 78 which lies on the angular rail 76.

The machine in accordance with the present invention operates in the following manner:

The roller pair 3 which is driven intermittently in accordance with the working pace of the machine pulls the hose foil web 2 in correspondance with the bag length. The welding members 13 and 14 and the clamping members 24 and 26 are displaced from one another so that the foil web 2 can run under the action of the roller pair 3 unobjectionably through the welding station 5. The foil web 2 is transported through guiding plate 28 centrally through the welding device 5. By actuating of the cylinder-and-piston units 27, the moveable clamping members 26 are pressed against the stationary clamping member 24. After this, the cylinder-and-piston unit 31 is actuated. The separating cutter 29 moves thereby transverse to the foil web 2, so that the hose piece corresponding to the bag length is separated from the foil web 2. After closing the clamping members 24 and 26, the cylinder-and-piston unit 23 is actuated so that the welding members 13 and 14 are pivoted in opposite directions and closed for formation of a bottom weld seam. Before the moveable clamping members 26 are opened by repeated actuation of the cylinder-and-piston units 27, the grippers 36 and 37 brought on the carriage pair 32 take the bag separated from the foil web 2. Before taking the bag, the carriage displaces in its right end position, as can be seen in FIG. 1. The carriage pair 33 is displaceably supported on the guide rods 33 and 34 and move by a cylinder-and-piston unit 79 with the pace of the machine from its right end position to its left end position. The grippers 36 and 37 are closed by actuation of the cylinder-and-piston unit 41. After closing of the grippers 36 and 37, the cylinder-and-piston unit 79 is actuated, whereby the carriage pair 32 is displaced to its left end position. The bag is thereby transported to the opening station 6.

The upper end which are not welded is opened by the suction pipes 42 and 43. By switching the cylinder-and-piston unit 41, the grippers 36 and 37 are opened and the carriage pair 33 is displaced by switching of the cylinder-and-piston unit 79 to its right end position. The gripping plate 46 mounted on the feeding arm 47 arrives thereby in the region of the opened bag. By a not-shown control of the cylinder-and-piston units 53 and 54, the feeding arm 47 is displaced in such a position that the gripping plate 46 lies relative to the upper end of the bag higher. By actuation of the cylinder-and-piston unit 57, the plate 51 displaces with the feeding arm 47 mounted thereon to the center of the bag. The feeding arm 47 is then pivoted by the cylinder-and-piston units 53 and 54 in a horizontal position. After this, the plate 51 by switching of the cylinder-and-piston unit 57 displaces outwardly transverse to the carriage pair 32. In this position the gripping plate 46 takes the bag and expands the opening. The cylinder-and-piston units 53 and 54 are then so actuated that the gripping plate 46 is pivoted so that the bag edge is located below the suction pipes 42 and 43. Since the gripping plate 46 is smaller than the bag opening, an insertion of the gripper plate 46 into the opened bag is guaranteed. The position of the gripping plate 46 required for taking the bag is shown in FIG. 7.

The weld seam located at the lower end of the bag is cooled on the way from the welding device to the opening station 5 by a cooling device 66 composed of blast nozzles 80. The carriage pair 32 displaces then by actuation of the cylinder-and-piston units 79 to its left end position. A reflecting light sensor 84 controls this position in order to have available a bag by the bag feeding device 45 for feeding to the filling pipe 81. When the bag is available, the reflecting light sensor 84 releases the working cycle of the filling pipe 81, and the filling pipe 81 lowers into the bag opening also in a known manner, and the bag is taken also in a known manner by jaws 82 and 83.

The gripping plate 46 is lifted by actuation of the cylinder-and-piston units 53 and 54 and displaces inwardly by actuation of the piston-and-cylinder unit 57. The carriage pair 32 displaces to its right position by actuation of the cylinder-and-piston unit 79. The bag after filling is placed on the conveyor transporting band driven in accordance with working pace of the machine. For adjusting the distance between the filling pipe 81 and the conveyor transporting band 9 in the event of a different dimension of the bag or a different filling volumes, the drive motor 70 is turned on within a short time.

After filling the bag, the grippers 58 and 59 brought on the carriage pair 32 take the bag 32 in a known manner. By actuating of the cylinder-and-piston unit 79, the carriage pair 32 again displaces to its left end position. Synchronously with the carriage pair 32, the conveyor transporting band 9 is driven for tranporting the filled bag to the welding device 8. The bag is provided in a known manner with a closing seam by the welding device 8. The welding devices 5 and 8 are advantageously identical. For service and in some cases repair work, the welding devices 5 and 8 may displace as a complete working unit on the angular rail 56. Thereby a good accessibility is guaranteed.

Figure 3:
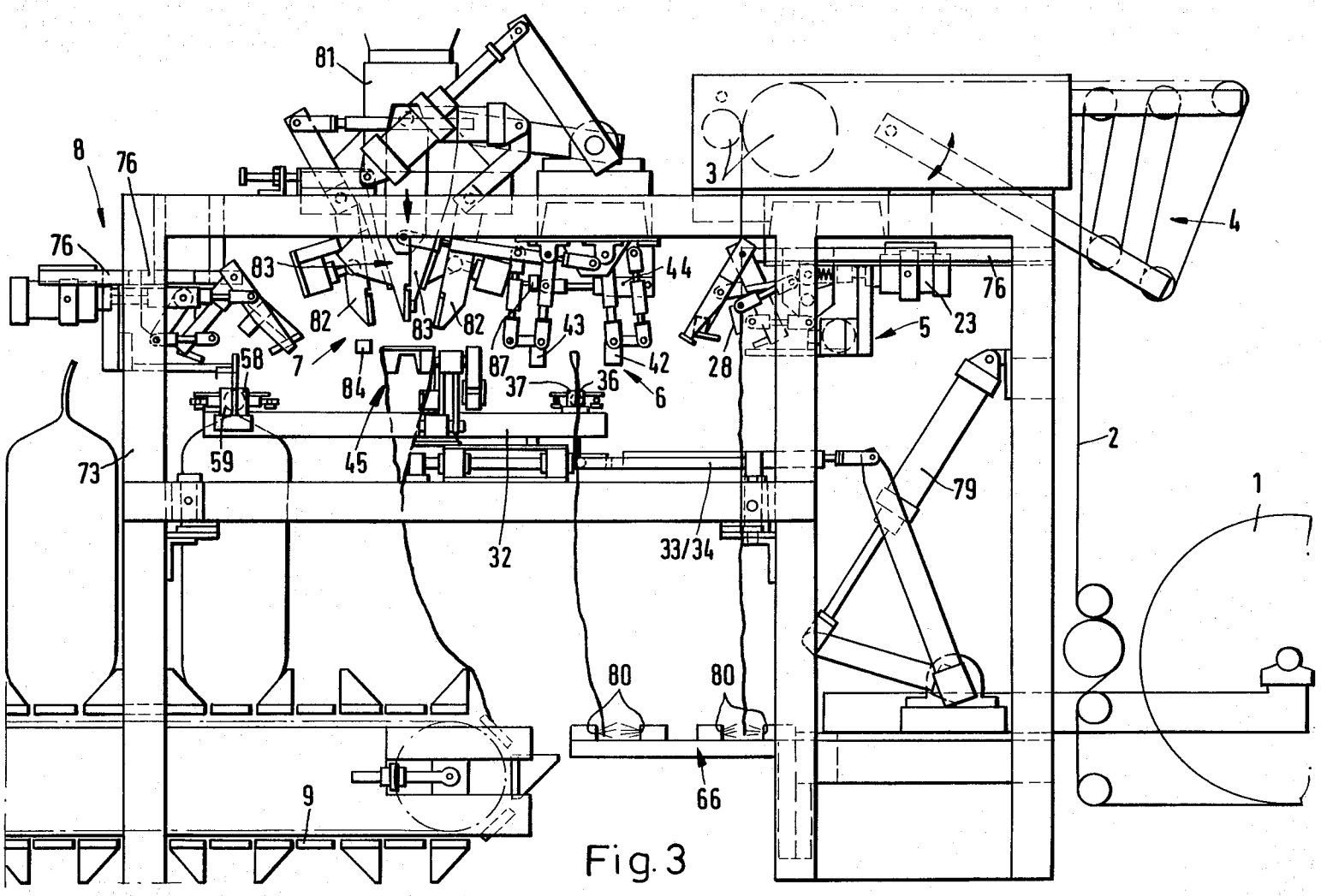
FIG. 3 is a lateral view of the machine in accordance with a first embodiment.

As can be seen from FIG. 3, the gripping plate 46 is provided with a central recess. It is thereby guaranteed that in the event of lateral fold bags, the lateral folds are not contacted during insertion of the gripping plate 46. As can be seen particularly from FIGS. 6 and 8, a lateral fold bag is provided with a rectangular filling opening. Thereby it is guaranteed that after filling of the bag, the lateral folds can be folded back to the initial position.

In the embodiments shown in FIGS. 1 and 3, the carriage pair 32 is provided with three stations. This results in that in the right end position of the carriage pair 32 a bag is taken from the welding device 5 via the grippers 36 and 37, simultaneously a bag is taken by the gripping plate 46 from the suction pipes 42 and 43, and also simultaneously a filled bag is taken by the grippers 58 and 59 from the filling pipe 81. In the left end position of the carriage pair 32, to the contrary, a bag is taken by the grippers 36 and 37 from the suction pipe 42 and 43, simultaneously a bag is taken from the jaws 82 and 83 by the gripping plate 46 and simultaneously a bag is taken from the welding device 8 by the grippers 58 and 59. Since the bags are displaced and taken by the grippers in correct positions to the individual working stations, a compact construction with accessible and reliable working cycle is guaranteed.

In the embodiment shown in FIG. 2, the gripper 65 arranged on the gripping chain 64 takes the bag separated from the loop foil web 2. The bottom weld seam is cooled during transporting toward the grippers 36 and 37 arranged on the carriage pair 32 by blasting nozzles 80 of the cooling device 66. Moreover, a further welding device 11 for closing the upper bag end is provided. The carriage pair 32 has then additional grippers 58' and 59'.

The welding device 8 is formed as a pre-welding device, whereas the welding device 11 is formed as a postwelding device and can be used as a corner welding device.

In this embodiment the carriage pair 32 is provided with four stations. It simultaneously performs four working steps. In this case a further welding device 12 is arranged after the welding device 5. It is possible to conduct a prewelding or corner welding. By the corner welding, a projecting bag corners are avoided, which are disturbing during transportation and palletizing.

The devices shown in FIGS. 6–11 are shown only for one machine side. The other machine side is mirror-symmetrical.

It will be understood that each of the elements described above, or two or more together, may also find a useful application in other types of constructions differing from the types described above.

While the invention has been illustrated and described as embodied in a machine for filling and closing bags of a synthetic plastic material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A machine for filling and closing bags of synthetic plastic material, comprising lowerable filling means;

transporting means spaced downwardly from said lowerable filling means and intermittently movable in a longitudinal direction to support and transport the bags;

a pair of carriages mounted in a space between said transporting means and said lowerable filling means at a distance corresponding to a bag width, means for reciprocatingly moving said carriages in a horizontal plane between two end positions and synchronously with said transporting means parallel to said longitudinal direction so that the bags are arranged transverse to the movement direction of said pair of carriages;

stations for forming opening, filling and welding;

feeding means on said pair of carriages and having two feeding arms which are provided with gripping plates, means for moving said feeding arms in said opening station from an upper position to a central position toward each other to be inserted into a bag mouth, then to a lower position in the bag and then away from each other to spread the bag and after spreding the bag, moving said feeding arms with said gripping plates further downwardly mounted to a lower transporting position; and two pairs of grippers arranged on said pair of carriages one pair being mounted on each side of said feeding means to grip bags below their mouth edges, one of said pairs of grippers being a front pair and arranged to bring an empty bag to said opening station, the feeding arms being arranged to bring a bag from said opening station to said filling station, and the other of said pairs of grippers being a rear pair and arranged for bringing a filled bag from said filling station to said welding station, so that three bags are simultaneously transported by said pair of carriages so that during the filling of the central bag one bag is opened and the already filled bag is welded.

2. A machine for filling and closing bags as defined in claim 1, wherein said carriages are movable in a horizontal plane.

3. A machine for filling and closing bags as defined in claim 1, wherein said feeding arms are movable in horizontal planes transverse to said carriages and supported pivotably about horizontal axes.

4. A machine for filling and closing bags as defined in claim 3, wherein said horizontal axes are defined by axles; and further comprising plates connected with said carriages and supporting said axles.

5. A machine for filling and closing bags as defined in claim 4; and further comprising levers forming parallel guides with which said plates are connected for movement in the horizontal plane.

6. A machine for filling and closing bags as defined in claim 5, wherein said plates for moving said feeding arms are movable in a direction transverse to said carriages; and further comprising a cylinder-and-piston unit arranged to move said plates.

7. A machine for filling and closing bags as defined in claim 1, wherein said gripping plates of said feeding means are releasably and adjustably connected with said feeding arms.

8. A machine for filling and closing bags as defined in claim 1; and further comprising opening means including suction pipes spaced from one another by a distance corresponding to a bag shape and a bag opening dimension, said gripping plates of said feeding means being smaller than said distance between said suction pipes.

9. A machine for filling and closing bags as defined in claim 1, wherein said gripping plates of said feeding means are provided with central recesses.

10. A machine for filling and closing bags as defined in claim 1, wherein said gripping plates of said feeding means have an asymmetrical shape.

11. A machine for filling and closing bags as defined in claim 3; and further comprising further cylinder-and-piston units arranged to pivot said feeding arms about the horizontal axis.

12. A machine for filling and closing bags as defined in claim 11, wherein said further cylinder-and-piston units are connected with one another in three predetermined positions.

13. A machine for filling and closing bags as defined in claim 1; and further comprising opening means including suction pipes, an additional cylinder-and-piston unit, and levers forming a parallel guide so that said additional cylinder-and-piston unit actuates said suction pipes via said parallel guide.

14. A machine for filling and closing bags as defined in claim 13; and further comprising an abutment arranged to centrally change a distance between said suction pipes and thereby to change a bag opening resulting from a bag shape and a bag dimension.

15. A machine for filling and closing bags as defined in claim 1; and further comprising two welding station arranged prior to and after said welding station, respectively.

16. A machine for filling and closing bags as defined in claim 15, wherein said welding means are identical with one another and each includes welding members and clamping members.

17. A machine for filling and closing bags as defined in claim 15, wherein said welding means includes first welding means located prior to said filling station and having separating means and another cylinder-and-piston unit actuating the latter.

18. A machine for filling and closing bags as defined in claim 15, wherein said welding members and said clamping members are supported floatably and pivotably about common horizontal axes.

19. A machine for filling and closing bags as defined in claim 18, wherein a foil web for forming the bags is located in a predetermined running plane, said horizontal axes of said welding members and said clamping members lie in said running plane of said hose foil web.

20. A machine for filling and closing bags as defined in claim 15; and further comprising a separate cylinder-and-piston unit which pivots exclusively said welding members.

21. A machine for filling and closing bags as defined in claim 15, wherein said welding means includes first welding means located prior to said filling station; and further comprising a guide plate associated with said first welding means and arranged for guiding a foil web for forming the bags.

22. A machine for filling and closing bags as defined in claim 15, wherein said welding means are formed as working units which are exchangeable.

23. A machine for filling and closing bags as defined in claim 15, wherein said welding means are formed as working units which are adjustable.

24. A machine for filling and closing bags as defined in claim 1, said filling station has cooling means for a bottom welding seam of the bags.

25. A machine for filling and closing bags as defined in claim 24, wherein said cooling means for the bottom welding seam includes two gripping chains which run in a horizontal plane and are provided with gripper pairs.

26. A machine for filling and closing bags as defined in claim 24, wherein said cooling means for the bottom welding seam is arranged to discharge a cooling medium.

27. A machine for filling and closing bags as defined in claim 15; and further comprising two further welding means located prior to and after said filling station, respectively.

28. A machine for filling and closing bags as defined in claim 15; and further comprising supply means for prepacked bags.

29. A machine for filling and closing bags as defined in claim 1; and further comprising a frame and means for height adjusting of said transporting band relative to said frame, said height adjusting means including spindles arranged on said frame and a drive for driving said spindles.

30. A machine for filling and closing bags as defined in claim 15; and further comprising controlling means provided in said filling station.

* * * * *